United States Patent [19]

Stahlecker

[11] Patent Number: 4,570,430

[45] Date of Patent: Feb. 18, 1986

[54] YARN PIECING ARRANGEMENT FOR AN OPEN-END FRICTION SPINNING MACHINE

[75] Inventor: Fritz Stahlecker, Bad Überkingen, Fed. Rep. of Germany

[73] Assignees: Hans Stahlecker; Fritz Stahlecker, both of Fed. Rep. of Germany

[21] Appl. No.: 631,075

[22] Filed: Jul. 16, 1984

[30] Foreign Application Priority Data

Jul. 19, 1983 [DE] Fed. Rep. of Germany ..... 3325928

[51] Int. Cl.[4] ..... D01H 15/02

[52] U.S. Cl. ..... 57/263; 57/261; 57/401; 57/405; 57/407

[58] Field of Search ..... 57/261, 263, 400, 401, 57/405, 407

[56] References Cited

U.S. PATENT DOCUMENTS

| | | | |
|---|---|---|---|
| 4,083,171 | 4/1978 | Konig et al. | 57/263 |
| 4,089,155 | 5/1978 | Stahlecker | 57/263 |
| 4,107,957 | 8/1978 | Stahlecker et al. | 57/263 |
| 4,120,140 | 10/1978 | Raasch et al. | 57/263 |
| 4,202,163 | 5/1980 | Turk et al. | 57/401 |
| 4,367,623 | 1/1983 | Parker et al. | 57/401 X |
| 4,380,892 | 4/1983 | Parker et al. | 57/401 |
| 4,471,606 | 9/1984 | Parker et al. | 57/401 X |

*Primary Examiner*—John Petrakes

*Attorney, Agent, or Firm*—Barnes & Thornburg

[57] ABSTRACT

A process and apparatus for piecing a yarn at a spinning unit of an open-end friction spinning machine is disclosed. Before the return of the yarn end, the wedge-shaped yarn forming gap is exposed by moving away a lid-type component containing at least one part of the fiber feeding channel, after which the yarn end is introduced into the mouth of the fiber feeding channel of this lid-type component, and subsequently, the lid-type component is returned to its position covering the wedge-shaped gap. Subsequently, the actual yarn piecing process is carried out by switching on the yarn withdrawal device and the yarn feeding device as well as by the transfer of the end of the yarn end to the wedge-shaped gap.

22 Claims, 7 Drawing Figures

YARN PIECING ARRANGEMENT FOR AN OPEN-END FRICTION SPINNING MACHINE

BACKGROUND AND SUMMARY OF THE INVENTION

This invention relates to a process and apparatus for piecing a yarn at a spinning unit of an open-end friction spinning machine. Such spinning units have two friction rollers that are drivable in the same rotational direction and are arranged next to one another to form a wedge-shaped gap. A feeding and opening device is provided for the feeding of single fibers, via a fiber-feeding channel, to the wedge-shaped gap. A yarn withdrawal device is provided for drawing off the formed yarn in the longitudinal direction of the wedge-shaped gap, and a suction device is provided for holding the forming yarn in the wedge-shaped gap. For the joining or piecing of the yarn, an already spun end of the yarn is returned and fed to the wedge-shaped gap, and the previously interrupted feeding of the individual fibers is resumed and the yarn is drawn off.

A piecing process for a spinning unit of an open-end friction spinning machine is known that must be carried out manually from European Published Unexamined Application (EP-OS) No. 34 427, where a yarn end is cut into a length in such a way that it reaches up to the feeding point of the fibers, and is then, via a yarn withdrawal tube, returned into the closed spinning unit. Special measures are taken at the spinning unit with the objective of holding the yarn in a stretched position and first bringing it into a position located at a distance to the wedge-shaped gap from where it is then to be transferred to the wedge-shaped gap in the stretched position. In the case of this design, the yarn end is essentially returned on the circumference of the roller that rotates into the wedge-shaped gap and is not interrupted in its drive. Then the fiber feeding device is turned on. Subsequently, the yarn withdrawal is resumed. The known process is difficult to carry out and offers no control as to whether the yarn end really arrives in the area of the feeding point since one cannot look into the wedge-shaped gap so that there is no possibility of control. There is also the danger that the yarn end moving on the roller rotating into the wedge-shaped gap takes up an uncontrolled position. It does not seem possible to produce even yarn piecing sections with this system that have such a high quality that they can remain in the yarn and do not interfere with further processing of the yarn.

The invention is based on the objective of providing a process and apparatus of the initially mentioned type by means of which it is possible to return the yarn end in a controlled manner for a yarn piecing process and to actually bring the yarn end into the area where the feeding of the fibers takes place.

This objective is achieved according to the invention by exposing the wedge-shaped gap, before the return of the yarn end, by moving away a lid-shaped component containing at least one part of the fiber feeding channel, by subsequently inserting the yarn end onto the mouth of the fiber feeding channel of the lid-shaped component, by then returning the lid-shaped component into its position covering the wedge-shaped gap, after which the actual piecing process takes place by switching on the yarn withdrawal device and the fiber feeding device and transferring the end of the yarn end to the wedge-shaped gap.

In a controlled manner, the yarn end is therefore, before the actual piecing process, returned in such a way that it is securely located in the area of the feeding point, namely in the area of the mouth of the fiber feeding channel. Since the spinning unit is opened for this purpose, a control of the return of the yarn end is possible without difficulty. The necessary work is simple to carry out so that, in particular, automatically operating machines may also be used. Because of the face that the yarn end comes to be located in the fiber feeding channel, it moves, when it is drawn off again, in the same direction as the refed fibers so that, together with the fibers, it reaches a position that is favorable with respect to piecing.

In an advantageous development of the invention, it is provided that the introduction of the yarn end into the fiber feeding channel of the lid-shaped component is supported by an air current directed at the yarn end and into the fiber feeding channel. As a result, the yarn end, in a simple manner, can be brought into the desired position while it is stretched simultaneously.

It is advantageously provided that, after the closing of the lid-type component, the yarn end is continuously returned. This ensures that the actual end of the yarn end reaches the area of the fiber feeding point, i.e., of the mouth of the fiber feeding channel, only after a certain time period after the yarn withdrawal device is turned on again, so that sufficient time is available for the individual steps of the piecing process. In this case, it is especially advantageous when the path covered by the end of the yarn end during rewithdrawal is monitored and that the passing of the end of the yarn end at one point is used as a signal for carrying out other operating steps of the piecing process. This makes it possible to exactly coordinate those individual operating steps with respect to time that must be carried out when the end of the yarn end passes the fiber feeding point.

In an advantageous development of the invention, it is provided that the drive of the rollers is interrupted during the return of the yarn end until the rewithdrawal of the yarn and/or the switching-on of the fiber feeding device. This ensures that the yarn end is not overwound or overtwisted by the rollers, which could reduce the quality of the yarn in the area of the yarn piecing section.

In an advantageous development according to the invention, it is provided that the yarn end is held at a distance to the wedge-shaped gap and is transferred to the wedge-shaped gap only after the fiber feeding device is turned on. Especially when the end of the yarn end was previously worked into a type of tuft or fiber-beard, there is the advantage that the end of the yarn end comes in contact with the already approaching flying fibers in the fiber feeding channel and moves in the same rotational direction with the fibers in the wedge-shaped gap so that qualitatively an especially good yarn piecing section can be obtained.

In a further development of the invention, a device for carrying out the process is provided where the spinning units, in each case, have a lid-shaped component that can be moved between an operating position covering the wedge-shaped gap and an open position exposing the wedge-shaped gap and that contains the mouth of the fiber feeding channel that is exposed in the open position. Because of this development, it is possible to return a yarn end in a simple manner for the piecing process and to position it in such a way that it is located at a point that is appropriate for spinning, i.e., at the feeding point, namely the mouth of the fiber feeding duct.

In a further development of the invention, a device is provided for the opening and closing of a spinning unit requiring maintenance, by moving away the lid-type component, and a device for the return of one yarn end which, in the open position, can be delivered to the mouth of the fiber feeding channel of the lid-type component. In this manner, the return of the yarn end can be automated.

In an advantageous development of the invention, it is provided that the device for the return of the yarn end into the fiber feeding duct of the lid-type component contains at least one blowing nozzle aimed into the fiber feeding channel. This facilitates the return of the yarn end and also achieves that this yarn end is stretched in the fiber feeding channel.

In a further development of the invention, a device for the switching-on of the fiber feeding mechanism is provided, permitting a coordination of the feeding with the piecing process.

In an especially advantageous development of the invention, a maintenance unit is provided that can be moved along the open-end friction spinning machine and contains the device for the opening and closing of the lid-type component, the device for the return and the rewithdrawal of the yarn end and the device for the switching-on of the fiber feeding mechanism. This results in the advantage that the devices carrying out the piecing process must only exist once. Another advantage is that by means of these devices, the same working motions are carried out for each piecing process in the same time-coordinated sequence. It is also possible to carry out the working sequences, especially the rewithdrawal of the yarn end and the switching-on of the fiber feeding mechanisms, at speeds that are suitable for spinning.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
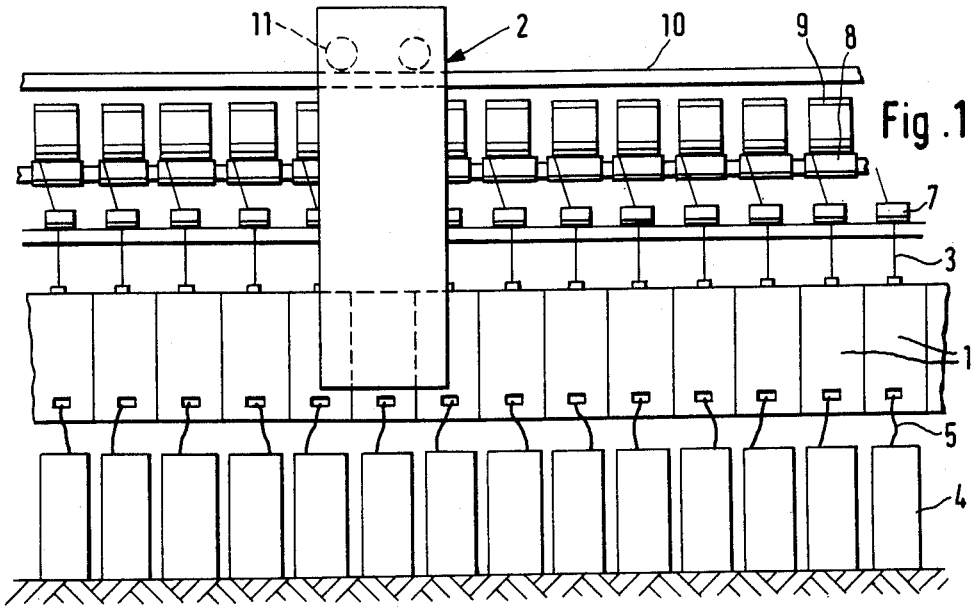
FIG. 1 is a schematic front view of a section of an open-end friction spinning machine having a plurality of spinning units arranged next to one another and a movable maintenance unit for carrying out the yarn piecing process, constructed in accordance with a preferred embodiment of the invention.

The shown open-end friction spinning machine (FIGS. 1 and 2) has a plurality of spinning units which are arranged in a row next to one another, preferably one row on each side of the machine, and which are developed identical with respect to one another. In a manner that will be described in the following, these spinning units 1 will be serviced by a movable maintenance unit 2. The maintenance unit 2 is moved in the machine longitudinal direction on rails 10 and 12 of the open-end friction spinning machine by means of running wheels 11, 13 and 14. The maintenance unit 2, in a manner that is not described in detail, is provided with devices for recognizing a maintenance requirement, for example, a yarn breakage. It will then be stopped at the respective spinning unit 1 requiring maintenance and will carry out the maintenance or servicing operations.

Each spinning unit 1 receives a sliver 5 from a can 4 that is spun into a yarn 3 which is drawn off by a pair of withdrawal rollers 7 and is wound on the winding spools 9. The pairs of withdrawal rollers 7, in each case, consist of a cylinder that is continuously driven in longitudinal direction of the machine and an electrically pressed pressure roller. The winding spool 9 is held at a spool frame 19 that can be swivelled around a shaft 20 and rests on a driven grooved drum 8.

Figure 3:
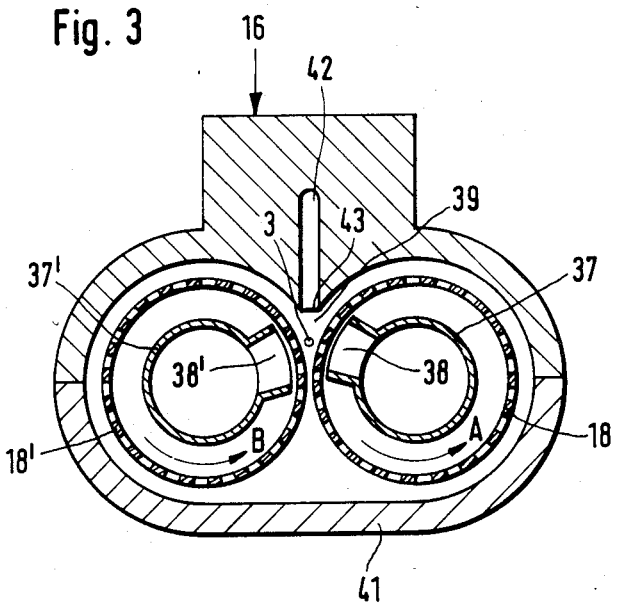
FIG. 3 is a sectional view through a portion of a spinning unit in the area of two friction rollers forming a wedge-shaped gap.
Figure 6:
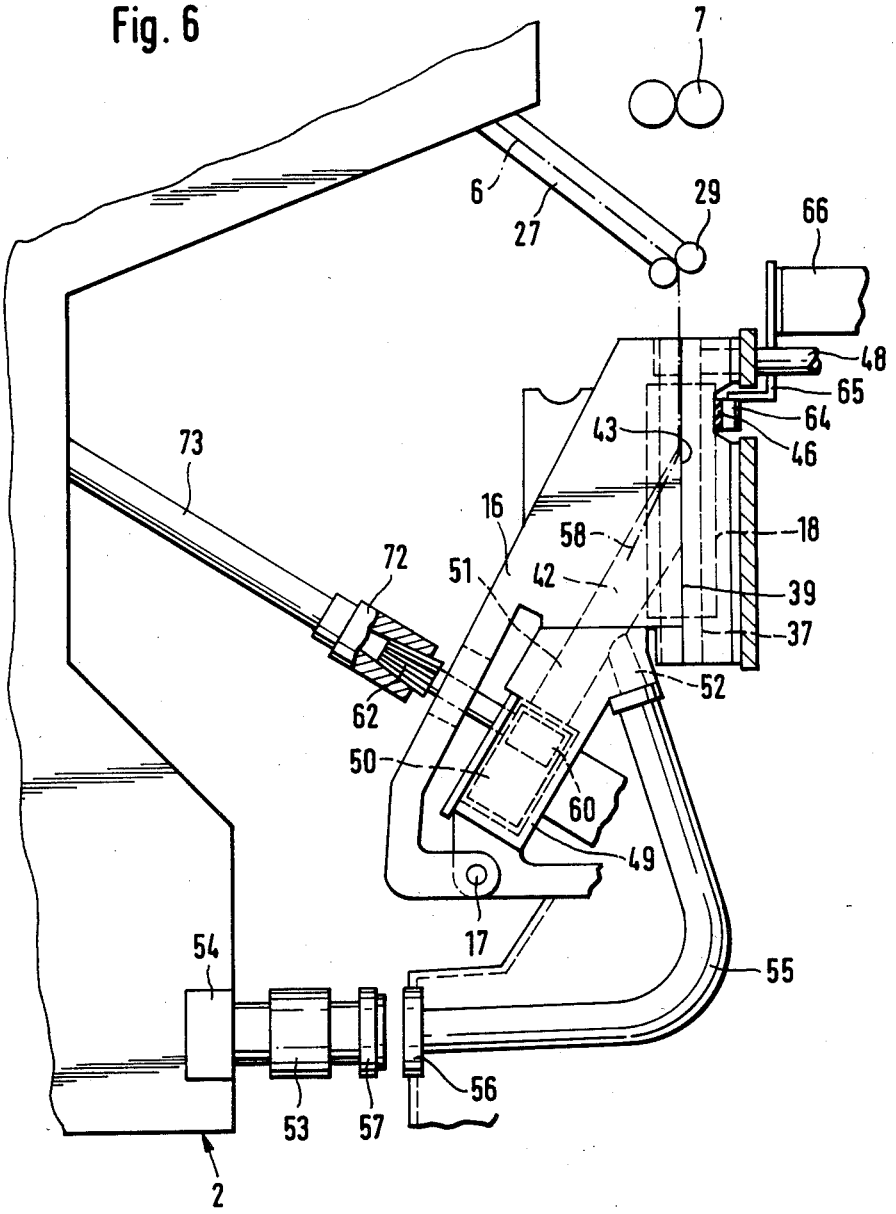
FIG. 6 is a sectional view through the spinning unit and a portion of the maintenance unit similar to FIGS. 4 and 5, depicting the piecing process.

Each spinning unit 1 (FIGS. 3 and 6) contains two rollers 18 and 18' that are driven by means of a tangential belt 46 in the same rotational direction A and B, said rollers 18 and 18' together forming a wedge-shaped gap 39 where the yarn 3 is produced. In the case of the shown embodiment, the rollers 18 and 18' are formed as so-called suction rollers. They have a perforated shell and a suction insert 37, 37' arranged on the inside which is connected to a low-pressure source and, via a slot opening 38, 38', open in the direction of the area of the wedge-shaped gap 39. Embodiments are also contemplated where one of the rollers 18' is formed with a closed shell that is provided with a coating or profiling to accommodate air flow thereby.

The rollers 18, 18' are disposed in a bearing housing 41 which is mounted at a machine frame 15 in a stationary manner. The bearing housing 41 has a notch 45 where the tangential belt 46 is located which runs in longitudinal direction of the machine and which rests against the outside surfaces of the shells of the rollers 18 and 18' of all spinning units 1 of one side of the machine and drives the rollers 18 and 18'. In the shown embodiment, the rollers 18 and 18' are disposed on the tube-shaped suction inserts 37 and 37' which are closed at both their ends and, via one connection 47 each, are connected to a low-pressure pipe 48.

At least in the area of the wedge-shaped gap 39, the rollers 18 and 18' are covered by means of a lid-type component 16 that can be moved away and in the closed position is supported at the bearing housing 41. The lid-type component 16 is provided with half-shell-shaped recesses corresponding to the contours of the rollers 18 and 18'. In a manner that is not shown, component 16 may be provided with air inlet openings which are arranged especially in the area of the roller 18' rotating out of the wedge-shaped gap and which promote a controlled air current in the area of the wedge-shaped gap 39.

The lid-type component 17 contains a portion 42 of a fiber feeding channel which, by means of a mouth 43, leads into the area of the wedge-shaped gap 39. The other portion, namely the portion 51 of the fiber feeding channel that is first in fiber transport direction, is disposed in a stationary housing 49 where an opening roller 50 and a feeding roller 60 are arranged which form a feeding and an opening device, by means of which the sliver 5 is opened up into individual fibers and in the form of these individual fibers is led into the area of the wedge-shaped gap 39. Such feeding and opening devices are known in the case of open-end rotor spinning machine. The yarn 3 twisted together in the wedge-shaped gap 39 is drawn off in longitudinal direction of the wedge-shaped gap 39 via the correspondingly arranged pair of withdrawal rollers 7.

The lid-type component 16 can be swivelled away around a swivelling axis 17 located preferably below the feeding and opening device and extending in longitudinal direction of the machine in such a way that the area of the wedge-shaped gap 39 between the rollers 18 and 18' can be exposed completely.

Each spinning unit 1 is provided with a yarn breakage sensor that is not shown and that is arranged between the rollers 18 and 18' and the pair of withdrawal rollers 7 or between the pair of withdrawal rollers 7 and the grooved drum 8. In the case of a yarn breakage, this yarn breakage sensor interrupts the further supply of the sliver 5 by, for example, uncoupling the feeding roller 60 from its central drive that is not shown, in which case the drive of each feeding roller 60 must then contain a corresponding switching coupling. It is also contemplated to interrupt the supply of the sliver 5 by the fact that a feeding table interacting with the feeding roller 60 is swivelled away from the feeding roller 60, possibly while the sliver 5 is clamped. The yarn breakage sensor also activates a signal transmitter assigned to each spinning unit 1, such as a light, to which a corresponding detector of the maintenance unit 2 is assigned which is then called to the spinning unit 1 requiring maintenance and will then carry out the required maintenance operation there. If necessary, the yarn monitor may also actuate a mechanism provided at each spinning unit by means of which the spool frame 19 is swivelled when a yarn breakage occurs and is lifted off the grooved roller 8. In the case of a yarn breakage at one or several spinning units, the drives of the other elements are not interrupted, i.e., the opening roller 50, the rollers 18 and 18', the withdrawal rollers 7 and the grooved rollers 8 are continuously driven at an unchanged speed. The required maintenance process is carried out by the called maintenance unit that is assigned and delivered to the corresponding spinning unit 1.

The maintenance unit 2 (FIG. 2) first opens the spinning unit 1 by swivelling away the lid-type component 16. For this purpose, the maintenance device 2 is provided with a press 34 including in the preferred embodiments an hydraulic piston cylinder unit which, by means of a spherical head 35 is selectively moved to a correspondingly developed slaving recess 36 of the component 16. Subsequently, the hydraulic press 34 by means of a motor drive, is swivelled around its swivelling axis 33 together with the component 16. Before the actual piecing process, it is now pactical to carry out a cleaning of the spinning unit 1, especially of the rollers 18 and 18', since contamination in this area may possibly be the cause of the yarn breakage. When the wedge-shaped gap 39 is exposed, such a cleaning is relatively simple using the suitable means of the maintenance unit 2 that are not shown.

The maintenance unit 2 then causes a return of a suitable yarn end 6 into the area of the wedge-shaped gap 39. For this purpose, the maintenance unit 2 is provided with a lift-off roller 22 which can be driven in both rotational directions. The lift-off roller 22 is arranged on a swivel arm 21 which, by means of a motor drive, can be swivelled around a swivel axis 23 in such a way that the lift-off roller 22 is supplied to the winding spool 9. Should the spool frame 19 not yet be lifted off by means of the spinning unit 1, the lift off roller 22 will lift the winding spool 9, together with the spool frame 19, off the grooved roller 8. The lift-off roller 22 will then drive the winding spool 9 against the normal winding direction.

The winding spool 9 is then supplied with a locator nozzle 25 arranged on a swivel arm 24 which can be swivelled around a swivel axis 26 by means of a motor drive so that the locator nozzle 25 is supplied to the circumference of the winding spool 9. The locator nozzle 25, together with the found yarn end 6, will then swivel away from the winding spool 9 and will deposit this yarn end 6 in a pair of auxiliary withdrawal rollers 29 which is opened by being moved apart. During the withdrawal of the yarn end 6 by means of the locator nozzle 25, the winding roller 9 is advantageously continuously driven in unwinding direction by means of the lift-off roller 22. The pair of auxiliarly withdrawal rollers 29 will then be closed, i.e., the two rollers rest against one another so that the yarn end 6 is clamped in.

The yarn end 6 held between the locator nozzles 25 and the pair of withdrawl rollers 29 is then supplied with a device for cutting it into lengths, which preferably consists of a driven frictional wheel 30 that is held on a swivel arm 31 which by means of a motor drive can be swivelled around a swivel shaft 32. The yarn end is cut by means of the frictional wheel 30 while simultaneously its actual free end is worked into a type of tuft or fiberbeard.

Figure 4:
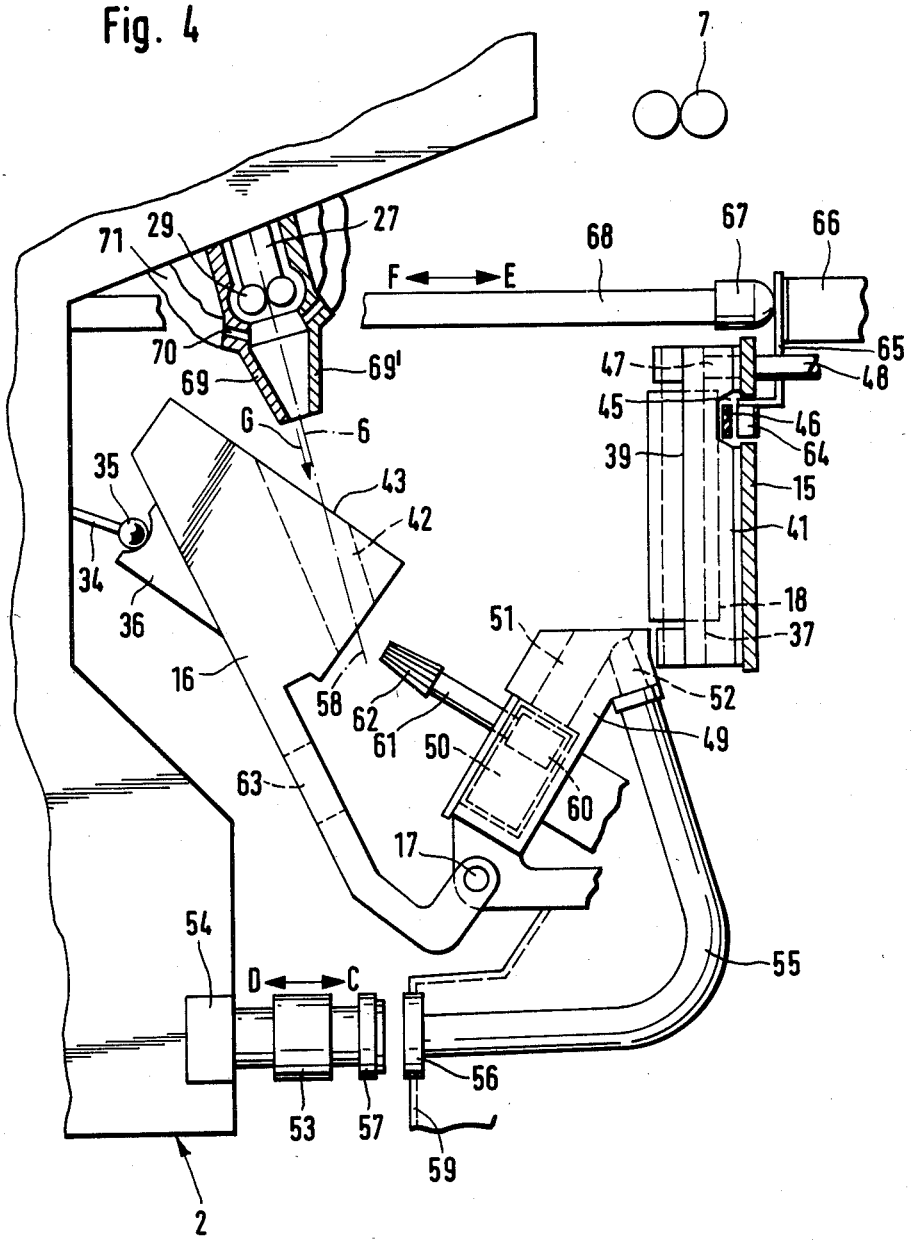
FIG. 4 is an enlarged sectional view through the open-end friction spinning machine and maintenance device constructed according to a preferred embodiment of the invention, during the opening of a spinning unit and the returning of the yarn end.

The pair of auxiliary withdrawal rollers 29 which then holds the yarn end 6 with the prepared end 58 is subsequently supplied to the spinning unit 1 (FIG. 4). For this purpose, the pair of auxiliary withdrawal rollers 29 is arranged on a swivel arm 27 which, by means of a motor drive, can be swivelled around its shaft 28 (FIG. 2). and can be supplied to the opened spinning unit (FIG. 4). The pair of auxiliary rollers 29 which is used as a yarn guiding element swivels so far into the area of the spinning unit 1 that the yarn end 6 can be introduced into the mouth 43 of the portion 42 of the fiber feeding channel of the swivelled away component 16 corresponding to the direction of the Arrow G (FIG. 4).

The yarn end 6 is advantageously introduced so far into the portion 42 of the fiber feeding channel that the yarn end 58 protrudes from the other side of portion 42. The introduction of yarn end 6 into portion 42 of the fiber feeding channel can be promoted by a supply of compressed air. For this purpose, the pair of auxiliary withdrawal rollers 29 is surrounded by a tongs-type device 69, 69', the tongs parts 69 and 69' of which can each separately be swivelled away from the pair of auxiliary withdrawal rollers 29 when their work is no longer required, for example, during the subsequent closing of the lid-type component 16. The tongs-type device 69, 69' has inlet openings 70 through which, via flexible pipes 71, compressed air can be supplied by means of a moving component in the direction of the Arrow G so that, on the one hand, the yarn end 6 can securely be introduced in part 42 of the fiber feeding channel and, on the other hand, can also be stretched in the process.

During the introduction of the yarn end 6 into part 52 of the fiber feeding duct of the lid type component 16, the roller 18 and 18' are advantageously interrupted from their operational drive 46. For this purpose, the maintenance unit 2 has an operating lever 68 that can be adjusted corresponding to the directions of Arrows E and F, said operating lever 68 being provided with a thrust piece 67. This thrust piece 67 may rest against a retainer 65, where a pressure roller 64 is provided for pressing the driving tangential belt 46 against the rollers 18 and 18'. This contact pressure of the pressure roller 64, during operation, takes place by means of a leaf spring 66. The operating lever 68 presses the pressure roller 64 against the effect of this leaf spring 66 away from the tangential belt 46 so that the tangential belt 46, because of the decreasing contact pressure tension, lifts off the surface of the rollers 18 and 18'. This interrupts the drive of the rollers 18, 18'. When it is desirable that the rollers 18 and 18' come to a stop more rapidly, an additional braking device may be provided that is not shown which can also be operable by means provided by the maintenance unit 2, for example, by providing brake linings at the operating lever 68 via leaf springs or similar devices, said brake linings resting against the shells of the rollers 18, 18' when the thrust piece 67 is supplied to the retaining means 65.

A suction nozzle 52 to which a suction pipe 55 is connected leads into part 51 of the fiber feeding channel of the stationary housing 49. The suction pipe 55 ends in a joining piece 56 to which a suction connection 57 of the mainteance unit 2 can be supplied corresponding to the direction of the Arrows D-C (FIG. 4). This suction connection contains a switching valve 53. In this case, the joining piece 56 and the suction connection 57 can be formed in such a way that the joining piece 56 is opened by the suction connection 57 and after its withdrawal, is closed again. In the area of the suction connection 57, the maintenance unit 2 is also provided with a signal transmitter 54 responding to the end 58 of the yarn end 6.

The feeding roller 60 is extended via a shaft 61 which, at its end, has a bevel wheel 62. In the maintenance unit 2, an auxiliary drive is assigned to the bevel wheel 62, said bevel wheel 62 being led to the outside through a recess 63 of the component 16, said auxiliary drive controlling the fiber feeding during the yarn piecing process. The auxiliary drive of the maintenance unit 2 contains a rod 73 which can be driven to carry out rotation by means of an electric motor, said rod 73, movably corresponding to the Arrows K and J (FIG. 5) being able to be coupled with the bevel wheel 62, by means of a corresponding inside-conical receiving means 72.

Figure 2:
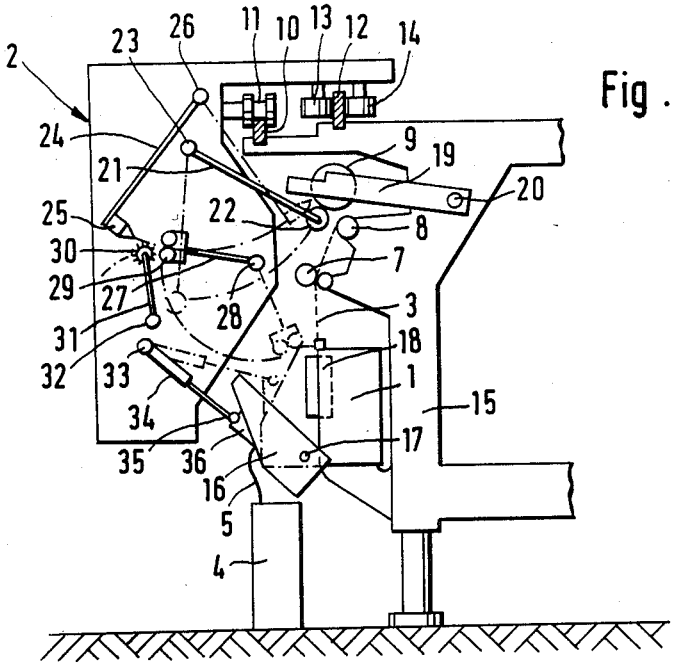
FIG. 2 is a schematic sectional view through the open-end friction spinning machine and the maintenance unit according to FIG. 1.
Figure 5:
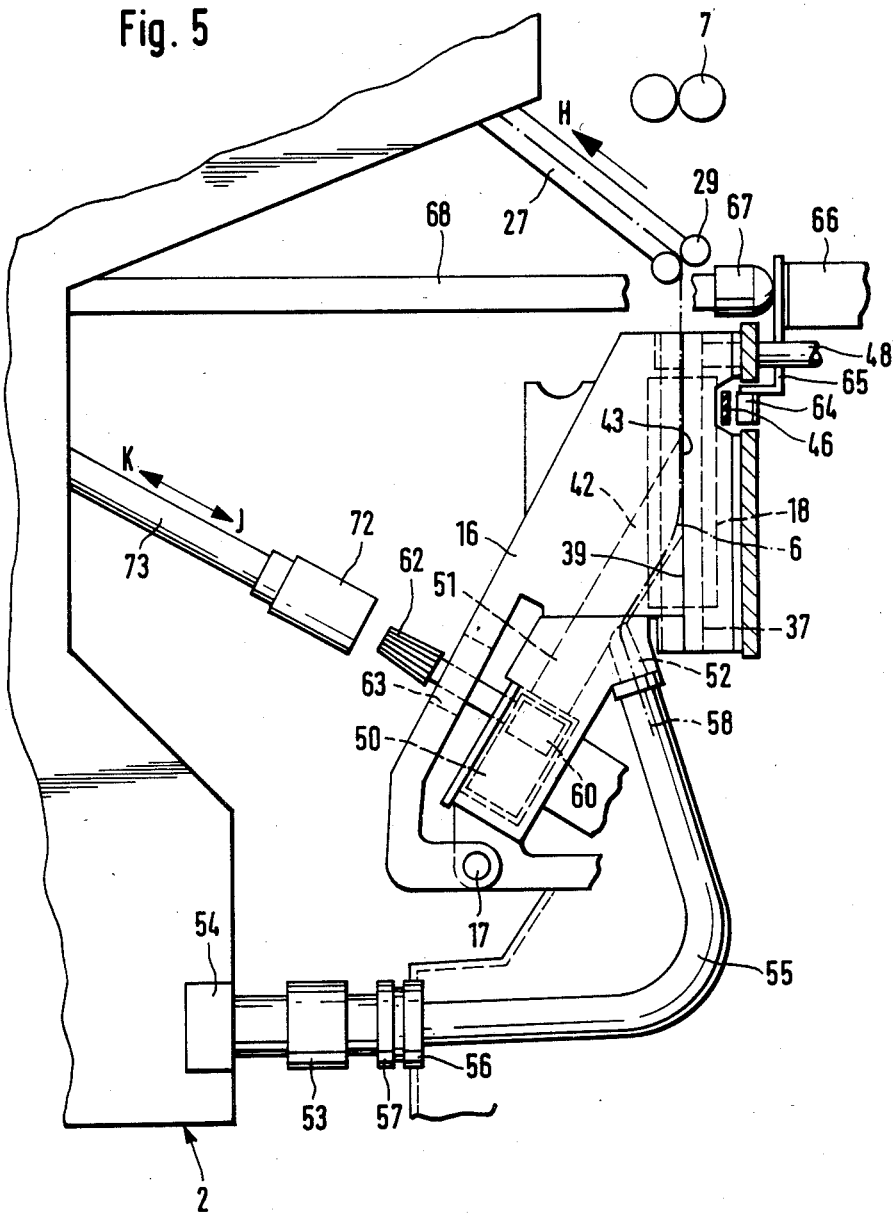
FIG. 5 is a sectional view that is similar to that of FIG. 4, depicting when the spinning unit is closed and the drive of the rollers is interrupted.

By means of the described devices, the following yarn piecing process is carried out after a yarn brakage. After the maintenance unit 2 has been called to a spinning unit 1 that requires maintenance or servicing, and has aligned itself with respect to this spinning unit 1, the maintenance unit opens the spinning unit 1 by swivelling away the lid-type component 16, so that the mouth 43 of the part 42 of the fiber feeding channel is exposed. After a cleaning process that was carried out as needed in the area of the rollers 18, 18', the yarn end 6 that was sought according to the above explanation and the FIG. 2 illustration, and was treated (by roller 30, for example) is introduced into part 42 of the fiber feeding channel. This introduction of the yarn end 6 is promoted by the blowing nozzle formed by the tongs-type parts 69, 69'. During that time, the operating rod 68 is moved out so that the drive of the rollers 18, 18' is interrupted. The yarn end 6 is returned so far into part 42 of the fiber feeding channel that its end protudes somewhat from the side facing away from the mouth. Then the tongs-type parts 69, 69' of the blowing nozzle are moved back. The maintenance unit 2 will then close the spinning unit 1 by swivelling back the component 16. Simultaneously, in the process, the pair of auxiliary withdrawal rollers 29 which is a pair of pinch rollers, is adjusted in such a way that it comes to be located as an extension of the wedge-shaped gap 39 (FIG. 5). In the process, the end 58 of the yarn end 6 reaches the area of the suction nozzle 52 to which low pressure is applied by the moving out of the suction connection 57 of the maintenance unit 2. Subsequently, the pair of auxiliary rollers 29 will be continued to be driven in unwinding direction so that the yarn end 6 is sucked back into the low-presure pipe 55 to the signal transmitter 54 which will then interrupt the continued return by switching off the drive of the pair of auxiliary rollers 29. It may be sufficient for this return according to certain embodiments of the invention, to only open the pair of auxiliary withdrawal rollers 29 developed as a pair of pinch rollers, without driving it, and to then close it again via the signal transmitter 54.

Subsequently, the pair of auxiliary withdrawal rollers 29 will be driven in reverse rotating direction so that the yarn end 6 is drawn off in the direction of the Arrow H (FIG. 5). In this case, a suitable withdrawal speed can be adjusted, such as a relatively slow withdrawal speed. The signal transmitter 54 supplies a signal to the programming control of the maintenance unit 2 when the end 58 of the yarn end 6 leaves its area, after which, at predetermined time intervals, the next steps of the yarn piecing process are initiated.

Before the end 58 of the yarn end 6 arrives in part 51 of the fiber feeding channel, the drive of the rollers 18, 18' will be switched on again by the withdrawal of the operating lever 68, where a soft start can be ensured by the type of withdrawal. Approximately simultaneously or shortly afterwards, the feeding is started so that fibers will be present in the wedge-shaped gap 39 when the end 58 of the yarn end reaches the area of the mouth. In this case, the end 58 of the yarn end 6 moves along the same path which the fibers take in portion 42 of the fiber feeding channel so here a tieing-up of the fibers with the prepared end 58 can already take place.

The withdrawal speed for the yarn end determined by the pair of auxiliary withdrawal rollers 29 and the feeding controlled by the auxiliary drive via the shaft 73 are proportioned in such a way that optimal conditions are obtained for the yarn piecing. In particular, the withdrawal speed as well as the feeding of the fibers are reduced. After the yarn piecing has taken place, the withdrawal speed and the fiber feeding are increased to operational conditions.

When the fiber feeding mechanism is switched on, the suction nozzle 52 is stopped by closing the valve 53 and/or withdrawing the suction connection 57.

After the yarn piecing process has taken place, the newly spun yarn is trasnferred to the withdrawal device 7 of the spinning unit 1, while the winding spool 9 is placed on the grooved roller 8. In this case, the newly spun yarn places itself against the not shown yarn guard so that said yarn guard is moved back into the operating position, switching the operational drive of the feeding roller 60 back on. Subsequently, the shaft 73 of the auxiliary drive of the maintenance unit 2 can be withdrawn so that the yarn piecing process is finally completed. The maintenance unit 2 will now be ready for the continuation of the monitoring drive.

Figure 7:
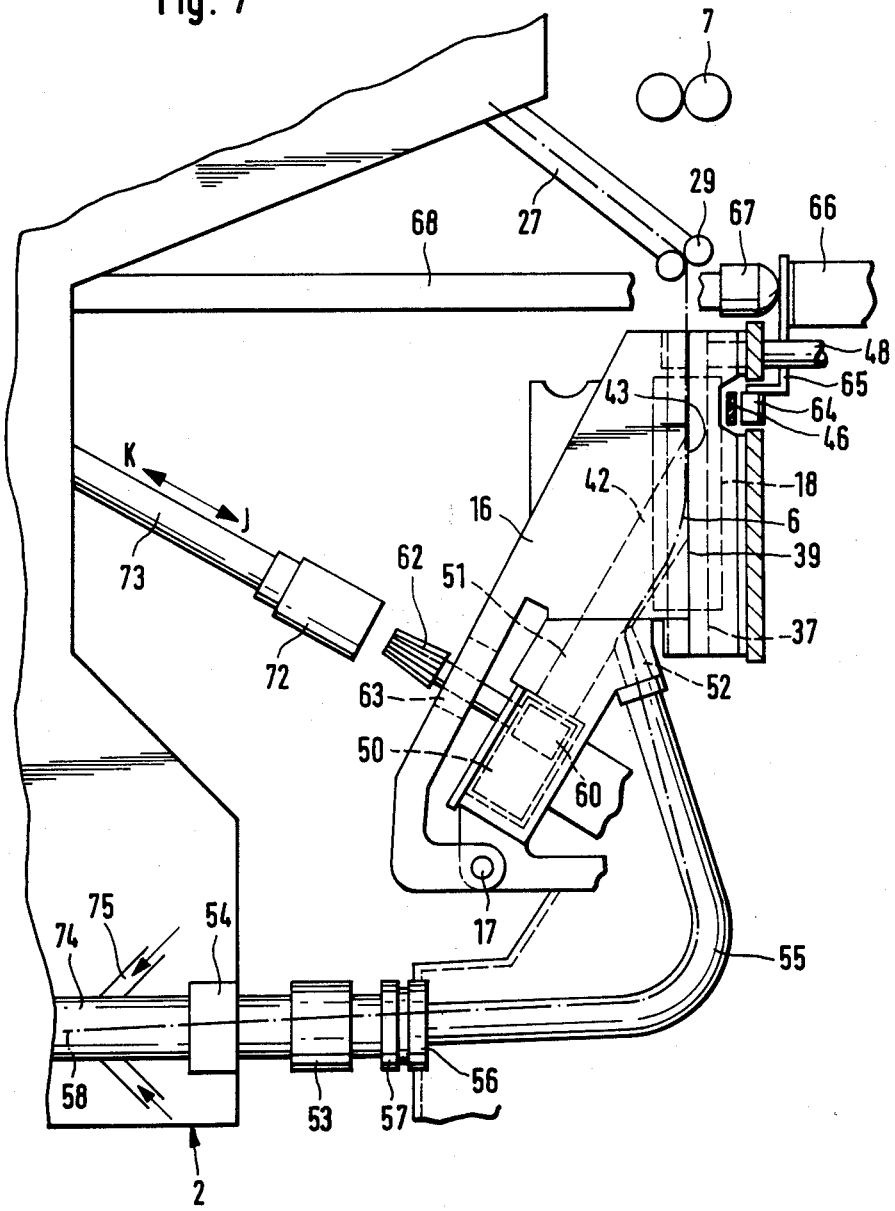
FIG. 7 is a sectional view similar to FIGS. 4 through 6, that is equipped with a device for treating the end of the yarn end, during a piecing process.

The prepartion of the end 58 of the yarn end 6 must take place while it is being cut into length before the return of the yarn end 6. Since the yarn end 6 will again arrive in the area of the maintenance unit 2, it is also possible to prepare the end 58 of the yarn end 6 after the return and before the withdrawal. According to FIG. 7, the maintenance unit 2 will then be provided with a device for the preparation of the end 58 arranged in the area of the signal transmitter 54, said end 58 being furnished with a corresponding length beyond the signal transmitter 54. In the case of the embodiment according to FIG. 7, a pneumatic device is provided, for example, by means of which the yarn end is prepared. It consists of a pipe 74 with blow nozzles 75 which are distributed over the circumference in such a way that an air whirl is created against the spinning direction of the yarn end 6. The yarn end 6 is thus de-spun and then separated so that a tuft or fiberbeard-like yarn end 58 is obtained. Since the signal transmitter 54 responds to the end 58 of the yarn end 6 and subsequently controls the individual steps, it is not important that it might not be possible to separate the yarn end at one certain point by means of such a pneumatic preparation device. However, it is also contempated by the invention to carry out a separating and preparing of the end 58 of the yarn end in this area by mans of a friction disk or a similar device.

Although the present invention has been described and illustrated in detail, it is to be clearly understood that the same is by way of illustration and example only, and is not to be taken by way of limitation The spirit and scope of the present invention are to be limited only by the terms of the appended claims.

What is claimed is:

1. Process for piecing yarn at a spinning unit of an open-end friction spinning machine of the type having:

a pair of friction rollers rotatably drivable in the same direction and disposed adjacent one another to form a yarn forming wedge-shaped gap therebetween, fiber feeding and opening device means including a fiber feeding channel means for feeding single fibers to the wedge-shaped gap, a part of the fiber feeding channel means being dispoed in a movable lid-shaped component covering at least a portion of the wedge-shaped gap and having a mouth opening to the wedge-shaped gap, yarn withdrawal means for withdrawing the formed yarn from the wedge-shaped gap, and suction device means for applying suction forces to hold the spinning yarn in the wedge-shaped gap, said process comprising the sequential steps of:

exposing at least a portion of the wedge-shaped gap by moving away the lid-shaped component, introducing the spun yarn end into the mouth of the fiber feeding channel means in the lid-shaped component, returning the lid-shaped component to its closed position covering the wedge-shaped gap, carrying out the yarn piecing steps of switching on of the yarn withdrawal means and the fiber feeding and opening device means, and of transferring the free end of the spun yarn end through the mouth opening of the fiber feeding channel means to the wedge-shaped gap.

2. A process according to claim 1, wherein the introducing of the yarn end into the mouth of the fiber feeding channel means of the lid shaped component is promoted by an air current aimed at the yarn end and into the fiber feeding channel means.

3. A process according to claim 2, wherein after the closing of the lid-shaped component, the yarn end returning is continued.

4. A process according to claim 1, wherein after the closing of the lid-shaped component, the yarn end returning is continued.

5. A process according to claim 1, wherein the path covered by the end of the yarn end during transfer to the wedge-shaped gap is monitored, and the passing of the end of the yarn end at a point is used as a signal for carrying out further operating steps of the yarn piecing process.

6. A process according to claim 1, characterized in that the drive of the friction rollers is interrupted during the return of the yarn end until the transfer to the wedge-shaped gap of the yarn and/or the switching-on of the fiber feeding and opening device means.

7. A process according to claim 1, wherein the yarn end is held at a distance from the wedge-shaped gap and is transferred to the wedge shaped gap only after the switching-on of the fiber feeding and opening device means.

8. A process according to claim 1, wherein the end of the yarn end, during withdrawal, is transferred to the wedge shaped gap.

9. Apparatus for open end friction spinning comprising a plurality of spinning units, each having:

a pair of friction rollers rotatably drivable in the same direction and disposed adjacent one another to form a yarn forming wede-shaped gap therebetween, fiber feeding and opening device means including a fiber feeding channel means for feeding single fibers to the wedge-shaped gap, a movable lid-shaped component covering at least a portion of the wedge-shaped gap and having a mouth opening to the wedge-shaped gap, at least a portion of the fiber feeding channel means being disposed in the movable lid-shaped component, yarn withdrawal means for withdrawing the formed yarn from the wedge-shaped gap, suction device means for applying suction forces to hold the spinning yarn in the wedge-shaped gap, the spun yarn and being insertable into the mouth of the fiber feeding channel means in the lid-shaped component when in the open position, and yarn piecing control means for carrying out piecing operations subsequent to return of the lid-shaped component to its closed position.

10. Apparatus according to claim 9, wherein component moving means are provided for the opening and closing of a spinning unit requiring maintenance by selectively moving away the lid-shaped component, and wherein yarn end introducing means are provided for the return of the yarn end and supplying it to the mouth of the fiber channel means of the lid-shaped component in the opened position.

11. Apparatus according to claim 10, wherein the yarn end introducing means contains at least one blow nozzle aimed into the fiber feeding channel means.

12. Apparatus according to claim 11, wherein yarn end introducing means for the return of the yarn end contains a pair of pinch rollers that preferably can be driven in both rotational directions, said pair of pinch rollers being able to be moved to the mouth of the fiber feeding channel means of the opened lid-shaped component and to the end of the wedge-shaped gap of the rollers.

13. Apparatus according to claim 10, wherein yarn end introducing means for the return of the yarn end contains a pair of pinch rollers that preferably can be driven in both rotational directions, said pair of pinch rollers being able to be moved to the mouth of the fiber feeding channel means of the opened lid-shaped component and to the end of the wedge-shaped gap of the rollers.

14. Apparatus according to claim 9, wherein a device is provided for interrupting the drive of the rollers to accommodate yarn piecing operations.

15. Apparatus according to claim 9, wherein a device is provided for switching on the fiber feeding mechanism to accommodate yarn piecing operations.

16. Apparatus according to claim 9, wherein the fiber feeding channel means of the lid-shaped component is an extension of a first section of the fiber feeding channel means disposed in a housing surrounding an opening roller, and wherein a suction nozzle for receiving the returned spun yarn end is located in the first section.

17. Apparatus according to claim 9, wherein a maintenance unit is provided that can be moved along the open-end friction spinning machine, said maintenance unit containing the component moving means for the opening and closing of the lid-shaped component, the yarn end introducing means, means for the rewithdrawal of the yarn end, and switching means for the switching-on of the fiber feeding and opening device means.

18. Apparatus according to claim 17, wherein the maintenance unit is provided with devices for interrupting the drive of the rollers.

19. Apparatus according to claim 17, wherein the maintenance unit is provided with a suction connection that can be supplied to a suction pipe leading to a suction nozzle for facilitating return of the yarn end subsequent to closing the lid-shaped component.

20. Apparatus according to claim 19, wherein the maintenance unit, in the area of the suction connection, is provided with a signal transmitter responding to the free end of the yarn end.

21. Apparatus according to claim 19, wherein the maintenance unit, in the area of the suction connection, is provided with a yarn end preparing device for preparing the free end of the yarn end.

22. Apparatus according to claim 21, wherein the yarn end preparing device includes a plurality of blow nozzles disposed to untwist the free yarn end.

* * * * *